US010587047B2

(12) United States Patent
Zhang et al.

(10) Patent No.: US 10,587,047 B2
(45) Date of Patent: Mar. 10, 2020

(54) DUAL-BAND FILTERING ANTENNA ARRAY USING FILTERING ANTENNA ELEMENTS FOR MUTUAL COUPLING SUPPRESSION

(71) Applicant: South China University of Technology, Guangzhou, Guangdong (CN)

(72) Inventors: Xiu Yin Zhang, Guangdong (CN); Yao Zhang, Guangdong (CN); Yong-Mei Pan, Guangdong (CN)

(73) Assignee: South China University of Technology, Guangzhou (CN)

( * ) Notice: Subject to any disclaimer, the term of this patent is extended or adjusted under 35 U.S.C. 154(b) by 517 days.

(21) Appl. No.: 15/455,100

(22) Filed: Mar. 9, 2017

(65) Prior Publication Data

US 2018/0034156 A1 Feb. 1, 2018

(30) Foreign Application Priority Data

Jul. 29, 2016 (CN) ..... 2016 1 0624802

(51) Int. Cl.
*H01Q 9/04* (2006.01)
*H01Q 21/06* (2006.01)
(Continued)

(52) U.S. Cl.
CPC ..... *H01Q 9/0414* (2013.01); *H01Q 1/246* (2013.01); *H01Q 1/38* (2013.01); *H01Q 1/523* (2013.01);
(Continued)

(58) Field of Classification Search
CPC ..... H01Q 9/0414; H01Q 13/106
See application file for complete search history.

(56) References Cited

U.S. PATENT DOCUMENTS 6,806,831 B2 * 10/2004 Johansson ..... H01Q 9/0414 343/700 MS
7,042,403 B2 * 5/2006 Colburn ..... H01Q 1/243 343/702

(Continued)

FOREIGN PATENT DOCUMENTS

CN 204947072 U * 1/2016

OTHER PUBLICATIONS

O. Hoseini Izadi and M. Mehrparvar, "A compact microstrip slot antenna with novel E-shaped coupling aperture," 2010 5th International Symposium on Telecommunications, Tehran, 2010, pp. 110-114. (Year: 2010).*

(Continued)

*Primary Examiner* — Jessica Han
*Assistant Examiner* — Amal Patel

(57) ABSTRACT

A filtering antenna element and a dual-band filtering antenna array using filtering antenna elements for mutual coupling suppression have been disclosed. The filtering antenna element comprises a feeding element, a sub-substrate, a sup-substrate and an air gap between the sub-substrate and the sup-substrate. A stacked patch is fabricated on a top surface of the sub-substrate, a driven patch and a ground plane are fabricated on a top surface and a bottom surface of the sub-substrate. An asymmetric E-slot is arranged on the driven patch and a shorting pin is inserted into the sub-substrate for generating radiation nulls in stopbands. The dual-band filtering antenna array is compact and needs no feeding network with an isolation of 35 dB, and is suitable for potential base station applications.

19 Claims, 14 Drawing Sheets

(51) Int. Cl.

| | |
|---|---|
| ***H01Q 21/08*** | (2006.01) |
| ***H01Q 5/30*** | (2015.01) |
| ***H01Q 1/38*** | (2006.01) |
| ***H01Q 1/48*** | (2006.01) |
| ***H01Q 1/24*** | (2006.01) |
| ***H01Q 1/52*** | (2006.01) |

(52) U.S. Cl.
CPC ..... *H01Q 5/30* (2015.01); *H01Q 9/0457* (2013.01); *H01Q 21/065* (2013.01); *H01Q 21/08* (2013.01)

(56) References Cited

U.S. PATENT DOCUMENTS

| | | | | |
|---|---|---|---|---|
| 7,589,676 | B2 * | 9/2009 | Popugaev ..... | H01Q 9/0414 343/700 MS |
| 2017/0054217 | A1 * | 2/2017 | Hashimoto ..... | H01Q 9/0457 |

OTHER PUBLICATIONS

A. E. S. Valavan, B. Yang, A. Yarovoy and L. P. Ligthart, "An M-band differentially fed, aperture coupled stacked patch antenna in LTCC," 2008 European Radar Conference, Amsterdam, 2008, pp. 200-203. (Year: 2008).*

Shailander Singh Khangarotl, Gajendra Sujediya, Tejpal Jhajharia, Abhishek Kumar, "Design and Fabrication of E-SLOT Microstrip Patch Antenna for WLAN Application," International Journal of Advanced Research in Computer and Communication Engineering, vol. 4, Issue 6, Jun. 2015 (Year: 2015).*

H. Malekpoor and S. Jam, "Miniaturised asymmetric E-shaped microstrip patch antenna with folded-patch feed," in IET Microwaves, Antennas & Propagation, vol. 7, No. 2, pp. 85-91, Jan. 29, 2013. (Year: 2013).*

Nurul H. Noordin et al., Triangular Lattices for Mutual Coupling Reduction in Patch Antenna Arrays, 2011 Loughborough Antennas & Propagation Conference, Nov. 14-15, 2011, pp. 1-4, Loughborough, UK.

Chi-Yuk Chiu et al., Reduction of Mutual Coupling Between Closely-Packed Antenna Elements, IEEE Transactions pn Antennas and Propagation, Jun. 2007, pp. 1732-1738, vol. 55.

Eva Rajo-Iglesias et al., Mutual Coupling Reduction in Patch Antenna Arrays by Using a Planar EBG Structure and a Multilayer Dielectric Substrate, IEEE Transactions on Antennas and Propagation, Jun. 2008, pp. 1648-1655, vol. 56.

Xuehui Guan et al., Compact and High-Isolation Diplexer Using Dual-Mode Stub-Loaded Resonators, IEEE Microwave and Wireless Components Letters, Jun. 2014, pp. 385-387, vol. 24.

* cited by examiner

DUAL-BAND FILTERING ANTENNA ARRAY USING FILTERING ANTENNA ELEMENTS FOR MUTUAL COUPLING SUPPRESSION

CROSS-REFERENCE TO RELATED APPLICATIONS

This application claims the benefit of Chinese patent application No. 201610624802.9 filed on Jul. 29, 2016, the contents of which are hereby incorporated by reference.

TECHNICAL FIELD

The present disclosure relates generally to mobile communications, and more particularly, to a filtering antenna element, and a dual-band filtering antenna array using filtering antenna elements for mutual coupling suppression.

BACKGROUND

With the development of mobile communications, multiband base station antenna arrays are required to simultaneously support multiband and multi-standard wireless systems. It is common to use sub-arrays operating at different bands to realize a dual- or multiband array when the operating frequency bands are far from each other, i.e., 820-960 and 1710-2170 MHz. However, due to serious mutual coupling between the sub-arrays, the method becomes inapplicable for designing arrays with very close frequency bands, such as DCS (1710-1880 MHz) and WCDMA (1920-2170 MHz) bands. Although increasing the su-barray separation can effectively reduce mutual coupling, the size of the array is getting bulky.

To solve this problem, two typical methods have been employed. One approach is to use a diplexer in cascade with a full-band antenna array to realize dual-band performance and compact size. Satisfying port isolation can be achieved by utilizing a diplexer. However, the insertion loss introduced by the diplexer becomes serious when the two operating bands are very close and antenna gain will be degraded. Moreover, it is difficult to individually control the downtilt of each band using only one antenna array, which cannot meet the requirements of wireless network optimization. The other approach is to use two full-band sub-arrays placed side by side with the same polarization direction. A decoupling feed network is necessary to be implemented to improve the port-to-port isolation and other additional decoupling networks have also been investigated, such as electromagnetic band-gap (EBG) structures, defected ground plane structures, band-stop decoupling units. It was found that these methods also affect the radiation performance of the antenna, such as radiation efficiency, front-to-back ratio, and antenna gain. The problem will be much toil less if the out-of-band radiation of two sub-array elements can be suppressed, and the mutual coupling will then be reduced at the same time.

Therefore, a heretofore unaddressed need exists in the art to address the aforementioned deficiencies and inadequacies.

SUMMARY

In one aspect, the present invention relates to a filtering antenna element comprising a feeding element, a sub-substrate, a sup-substrate and an air gap between the sub-substrate and the sup-substrate, wherein, a stacked patch is fabricated on a top surface of the sub-substrate, a driven patch and a ground plane are fabricated on a top surface and a bottom surface of the sub-substrate, respectively, wherein, an asymmetric E-slot is arranged on the driven patch and a shorting pin is inserted into the sub-substrate for generating radiation nulls in stopbands.

In a preferable embodiment, three shorting pins are provided, wherein, one shorting pin is located opposite to the feeding element, and other two shorting pins are positioned symmetrically with respect to a vertical axis of the sub-substrate.

In one preferable embodiment, the asymmetric E-slot has three slot arms with different lengths. In the present embodiment, a middle slot arm of the asymmetric E-slot is shorter that two side slot arms of the asymmetric E-slot.

In one preferable embodiment, the filtering antenna element further comprises a supporting pillar for connecting the sub-substrate and the sup-substrate.

In another aspect, the present invention relates to a filtering antenna element comprising a feeding element, a sub-substrate, a sup-substrate and an air gap between the sub-substrate and the sup-substrate, wherein, a stacked patch is fabricated on a top surface of the sub-substrate, a driven patch and a ground plane are fabricated on a top surface and a bottom surface of the sub-substrate, respectively, wherein, a slot is arranged on the driven patch and three shorting pins are inserted into the sub-substrate for generating radiation nulls in stopbands, wherein one shorting pin is located opposite to the feeding element, and other two shorting pins are positioned symmetrically with respect to a vertical axis of the sub-substrate.

In one preferable embodiment, the slot is an asymmetric E-slot having three slot arms with different lengths, wherein a middle slot arm of the asymmetric E-slot is shorter that two side slot arms of the asymmetric E-slot.

In a further aspect, the present invention relates to a dual-band filtering antenna array comprising a first sub-array and a second sub-array arranged on a common ground plate, wherein, the first sub-array is operating at a first frequency band, and the second sub-array is operating at a second frequency band which is different from the first frequency band, wherein the first sub-array comprises at least one first filtering antenna element and the second sub-array comprises at least one second filtering antenna element, wherein the first filtering antenna element and the second filtering antenna element comprises a feeding element, a sub-substrate, a sup-substrate and an air gap between the sub-substrate and the sup-substrate, respectively, wherein, a stacked patch is fabricated on a top surface of the sub-substrate, a driven patch and a ground plane are fabricated on a top surface and a bottom surface of the sub-substrate, respectively, wherein, an asymmetric E-slot is arranged on the driven patch and an shorting pin is inserted into the sub-substrate for generating radiation nulls in stopbands.

In one preferable embodiment, the first filtering antenna element and the second filtering antenna element are different in size, wherein the first filtering antenna element has a large size, and the second filtering antenna element has a smaller size. In the present embodiment, the first frequency band is DCS frequency band, and the second frequency band is WCDMA frequency band.

In one preferable embodiment, the first sub-array comprises a plurality of first filtering antenna elements and the second sub-array comprises a plurality of second filtering antenna elements, wherein the first sub-array and the second sub-array are placed side-by side along a vertical direction. In one preferable embodiment, a distance between neighbor first filtering antenna elements is equal to a distance between neighbor second filtering antenna elements. In the present embodiment, the first sub-array comprises six filtering antenna elements and the second sub-array comprises six second filtering antenna elements.

In one preferable embodiment, an offset of a fixed distance is arranged between the first sub-array and the second sub-array in a horizontal direction.

In one preferable embodiment, at least two reflection baffles are added on edges of the common ground plate. In the present embodiment, the reflection baffles can be vertical aluminum reflection baffles with different heights.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE PREFERRED EMBODIMENT

Figure 1:
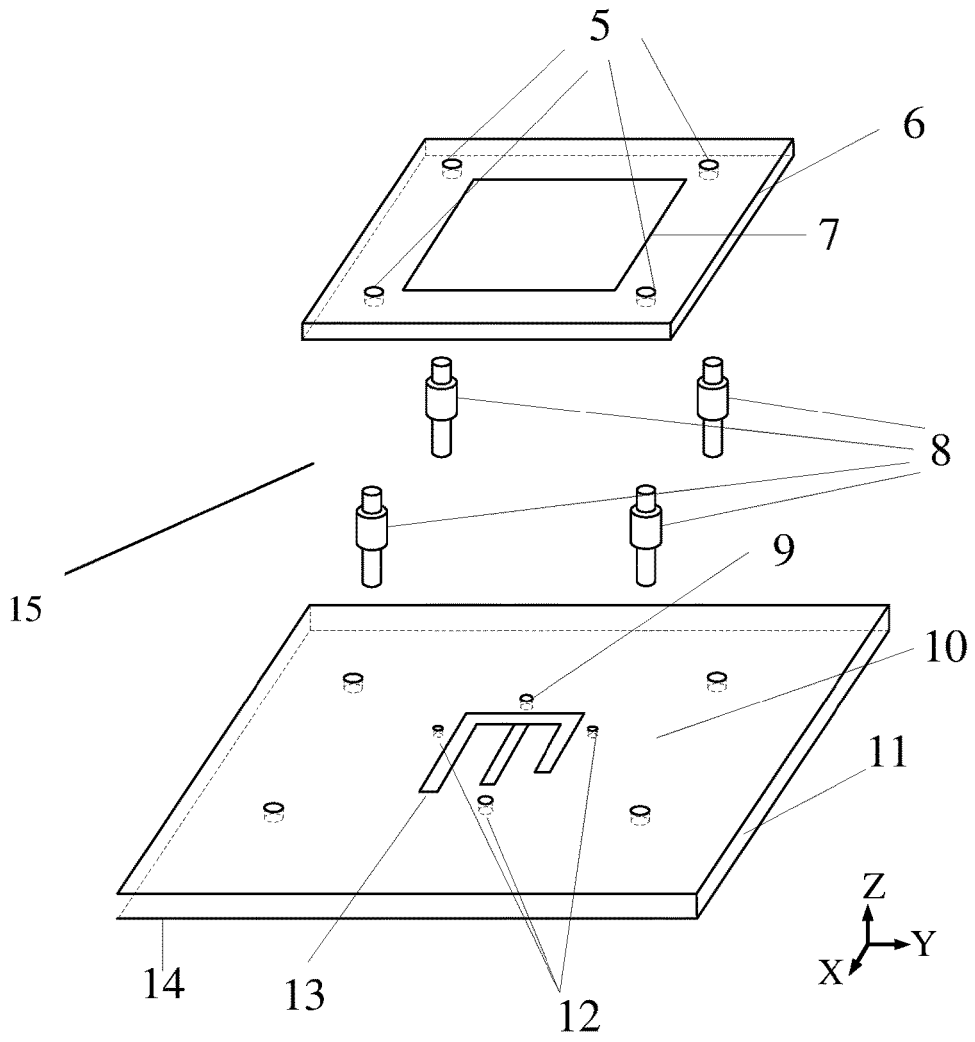
FIG. 1 is an explosive diagram of the filtering antenna element according to one embodiment of the present application.
Figure 2:
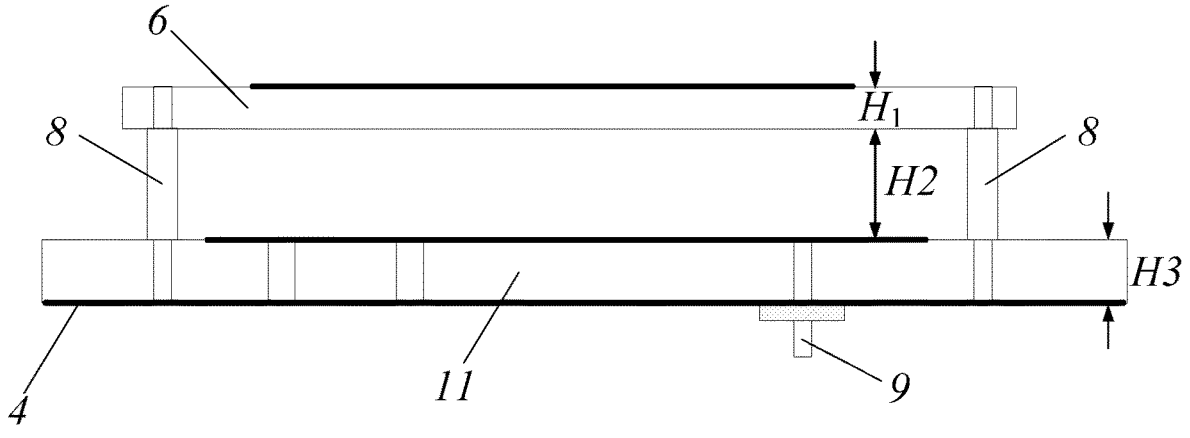
FIG. 2 is a side view of the filtering antenna element shown in FIG. 1.
Figure 3:
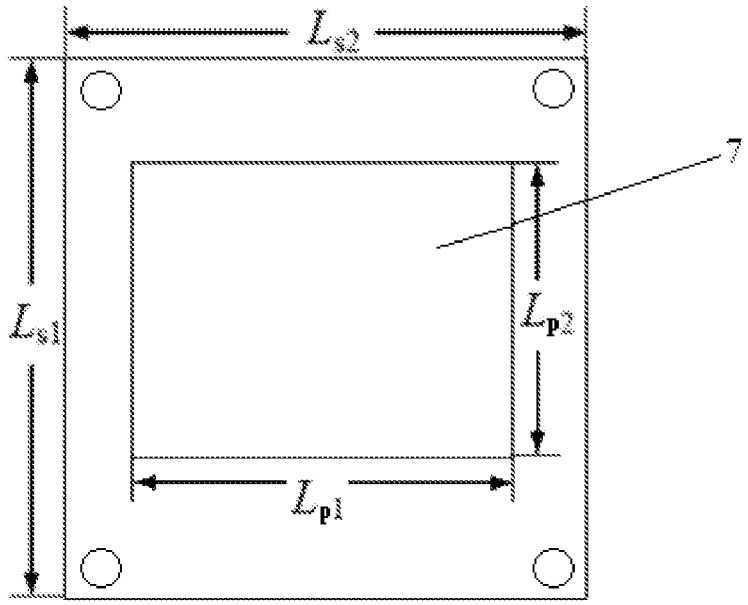
FIG. 3 is a top view of the filtering antenna element shown in FIG. 1.
Figure 4:
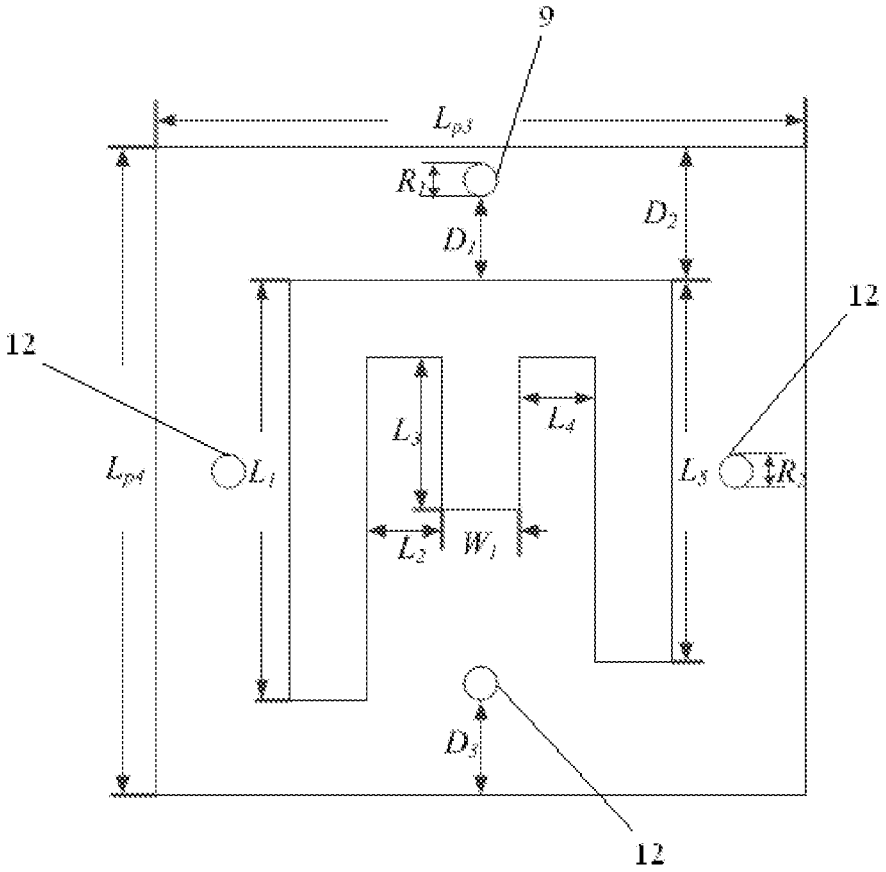
FIG. 4 is a bottom view of the filtering antenna element shown in FIG. 1.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views.

As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, "around", "about" or "approximate" shall generally mean within 10 percent, preferably within 5 percent, and more preferably within 3 percent of a given value or range. Numerical quantities given herein are approximate, meaning that the term "around", "about" or "approximate" can be inferred if not expressly stated.

As used herein, the terms "comprising," "including," "having," "containing," "involving," and the like are to be understood to be open-ended, i.e., to mean including but not limited to.

The description will be made as to the embodiments of the present invention in conjunction with the accompanying drawings in FIGS. 1-18D. In accordance with the purposes of this disclosure, as embodied and broadly described herein, this disclosure, in one aspect, relates to a filtering antenna element, and a dual-band filtering antenna array using filtering antenna elements for mutual coupling suppression.

Referring FIG. 1-4, a filtering antenna element is disclosed, which includes a feeding element 9, a sub-substrate 11, a sup-substrate band an air gap 15 between the sub-substrate 11 and the sup-substrate 6. As shown in FIG. 1-4, a rectangular stacked patch 7 is fabricated on the top of the sub-substrate 11 with a relative permittivity of 2.65 and a thickness of 2 mm, whereas the driven patch 10 and the ground plane 14 are printed on the top surface and bottom surface of the sub-substrate 11 with the same relative permittivity of 2.65 but a thickness of 3 mm. The air gap 15 introduced between the sub-substrate 11 and sup-substrate 6 has the height of H2. The filtering antenna element can be excited by an SMA connector, which is fixed at the edge of the driven patch 10. In order to integrate the filtering function, a shorting pin 12 having a diameter of 1 mm is inserted into the sub-substrate for generating radiation nulls in stopbands. In the present embodiment, three shorting pins 12 are inserted into the sub-substrate 11 for generating radiation nulls in the stopband. Specifically, one shorting pin 12 is located opposite to the feeding element 9, and the other two shorting pins 12 are positioned symmetrically with respect to y-axis to produce out-of-phase currents and generate corresponding radiation nulls. The positions of the shorting pins affect not only the frequency of radiation null but also the input impedance of the filtering antenna element. Thus, an optimization is required in the design to realize both satisfactory radiating and filtering performances.

As shown in FIG. 1, an asymmetric E-slot 13 is employed so as to offer more freedom for resonant frequency control and bandwidth adjustment. The asymmetric E-slot 13 has three slot arms with different lengths of L1, L3, and L5, and the spacing between the slot arms are given by L2 and L4. In the present embodiment, a middle slot arm of the asymmetric E-slot is shorter that two side slot arms of the asymmetric E-slot.

In other embodiment of the present application, a U-shaped slot also can be employed. By introducing the U/E-shaped slot into the filtering antenna element, the length of the current path is increased since the current has to flow around the slots. As a result, an additional resonant mode is generated and the impedance bandwidth of the patch antenna can be enhanced. Furthermore, applying the asymmetric E-slot 13 can also generate an additional radiation null at the frequency of ~$0.5c/l_0$ ($l_0$ is the total length of the E-slot), which is very essential for realizing the filtering function.

Further referring FIG. 1-4, the filtering antenna element further comprises a plastic supporting pillar 8 for connecting and fixing the rectangular sub-substrate 11 and the rectangular sup-substrate 6. In specific, there are four via holes 5 arranged at the four angles of the rectangular sub-substrate 11 and the rectangular sup-substrate 6 for connecting four plastic supporting pillars 8. A certain distance is arranged between the rectangular sub-substrate 11 and the rectangular sup-substrate 6 via the plastic supporting pillar 8. In a preferable embodiment, such distance can be adjusted for generating one high frequency radiation null at the left of the passbands. In such a way, the passband has one radiation null at both of the low frequency side and high frequency side, thus the band-pass characteristic of the filtering antenna element can be guaranteed.

Figure 5:
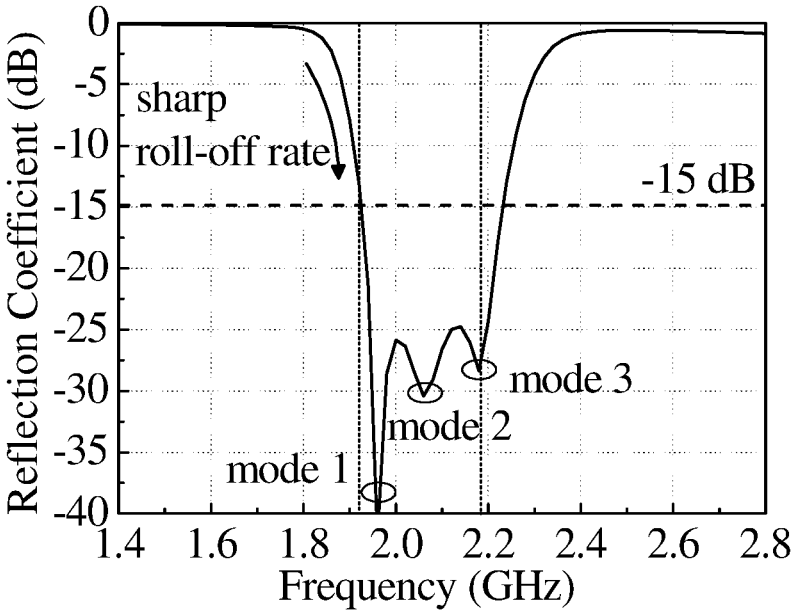
FIG. 5 is a diagram showing the simulated reflection coefficient of the filtering antenna element in FIG. 1 for WCDMA band.
Figure 6:
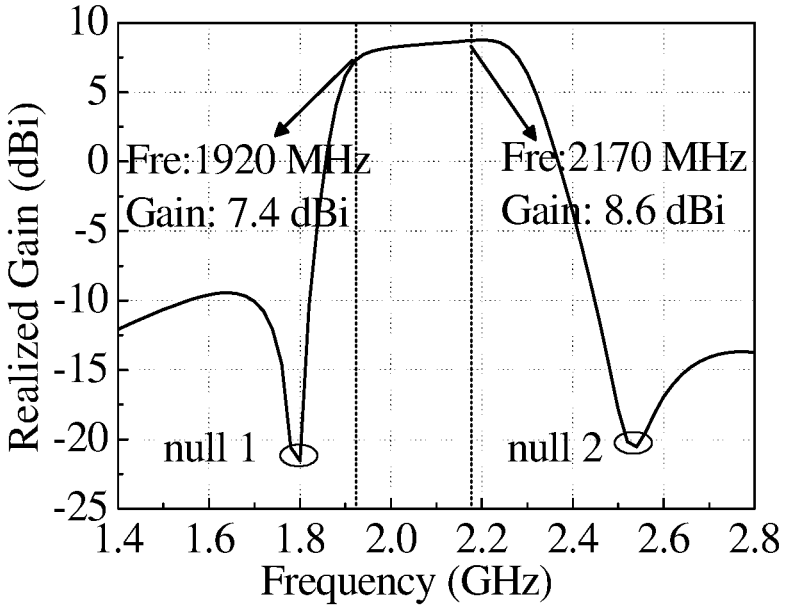
FIG. 6 is a diagram showing the boresight gain of the filtering antenna element in FIG. 1 for WCDMA band.

For demonstration, a filtering antenna element designed for WCDMA band (1920-2170 MHz) is presented. FIGS. 5-6 show the simulated reflection coefficient and boresight gain of the filtering antenna element designed for WCDMA band. It can be seen that the simulated impedance bandwidth ($|S11|<-15$ dB) is 14.9% (1920-2230 MHz). The filtering antenna element exhibits sharp roll-off rate at the upper and lower band edges. High out-of-band radiation suppression levels are obtained due to the radiation nulls generated by the shorting pins, the E-slot, and the stacked patch. The simulated in band gains are ~8 dBi, indicating that the in-band radiation efficiency is not degraded when high frequency selectivity and out-of-band rejection levels are obtained.

Figure 7:
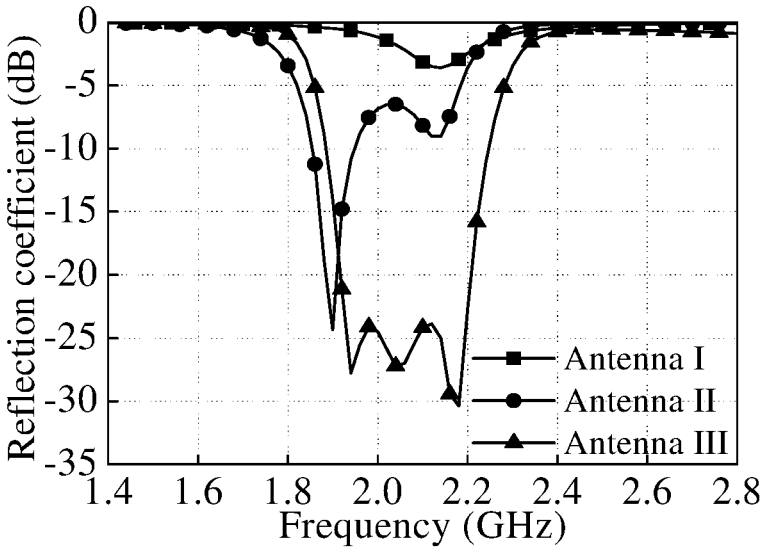
FIG. 7 is a diagram showing the reflection coefficients of Antenna I, Antenna II and Antenna III.

It is noted that three resonant modes are excited within the operating band, as illustrated in FIGS. 5-6. To characterize the resonant modes, three reference antennas are investigated and compared, which are Antenna I: single patch antenna, Antenna II: single patch antenna with an E-shaped slot, and Antenna III: stacked patch antenna with an E-shaped slot (which is filtering antenna element as shown in FIG. 1-4). Their corresponding reflection coefficients are shown in FIG. 7.

It can be seen that there is only one resonant mode for the single patch antenna. When an E-shaped slot is introduced into Antenna II, the second resonant mode is generated. And the third mode occurs when further adding a parasitic patch in Antenna III. The results indicate that the three resonant modes at 1.96, 2.06, and 2.18 GHz are caused by the E-shaped slot, the driven patch, and the stacked patch, respectively. Therefore, each resonant mode can be controlled by tuning corresponding parameters. On the other hand, it has been demonstrated in that the radiation nulls within stopband can be controlled by the shorting pins, E-slot, and stacked patch. Therefore, in general, the operating frequency and bandwidth of the filtering antenna element can be adjusted with the bandwidth ranging from 9% to 21%.

Figure 8:
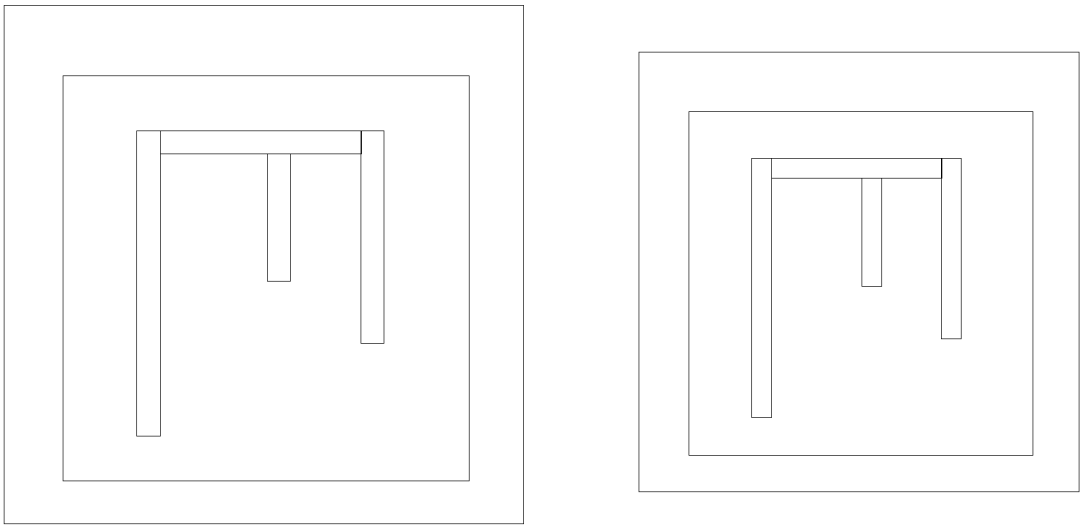
FIG. 8 is a diagram of the dual-band filtering antenna array according to one embodiment of the present application.
Figure 9A:
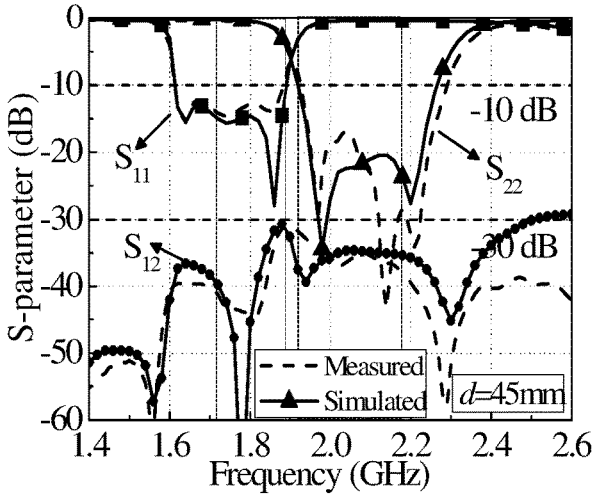
FIGS. 9A-9D are diagrams showing comparison results of the dual-band filtering antenna array of the present application and a traditional antenna array using two nonfiltering antenna elements.
Figure 9B:
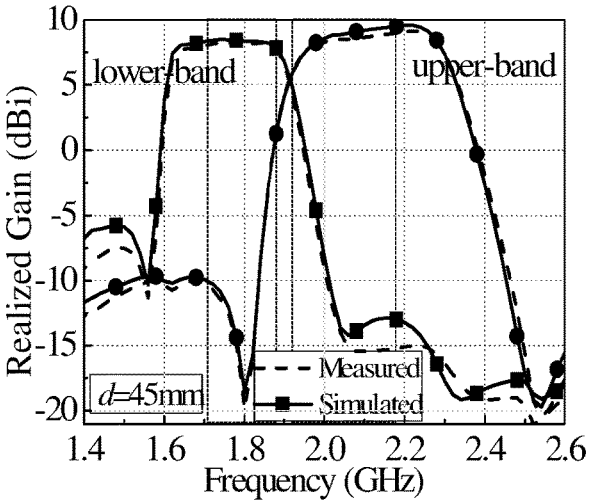
Figure 9C:
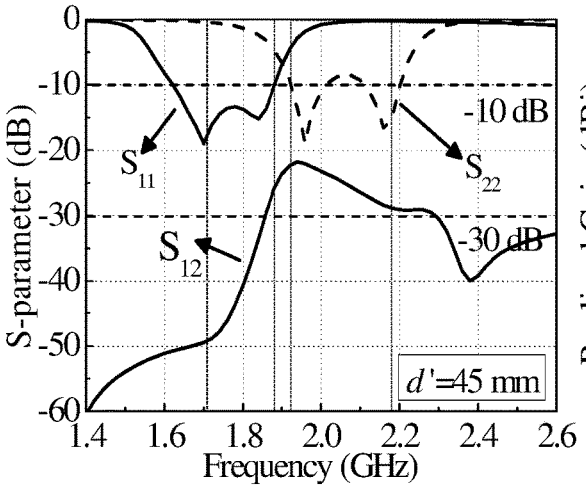
Figure 9D:
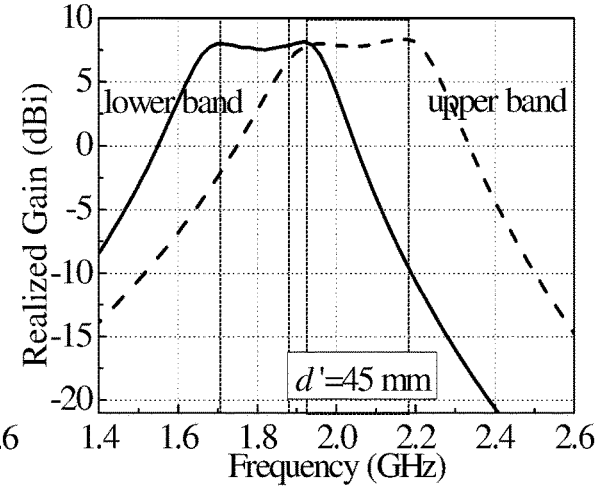

The present application further disclosed a dual-band filtering antenna array. FIG. 8 is a diagram of the dual-band filtering antenna array according to one embodiment of the present application. As shown in FIG. 8, the dual-band filtering antenna array includes a first sub-array 2 and a second sub-array 3 arranged on a common ground plate 4. In the present embodiment, the first sub-array 2 includes one first filtering antenna element and the second sub-array 3 includes one second filtering antenna element, too. The first filtering antenna element and the second filtering antenna element can be constructed according to the embodiments discussed above.

In order to achieve dual-band operation, the first filtering antenna element for DCS (1710-1880 MHz) and the second filtering antenna element for WCDMA (1920-2170 MHz) bands are designed and placed side by side to form a unit pair as shown in FIG. 8. All parameters for the first filtering antenna element and the second filtering antenna element are same as that shown in FIG. 1-4, and are tabulated in Table I.

TABLE I

DIMENSIONS (IN MILLIMETERS) OF THE FILTERING ANTENNA UNIT PAIR

| Parameter | $L_{s1}$ | $L_{s2}$ | $L_{p1}$ | $L_{p2}$ | $L_{p3}$ | $L_{p4}$ | $L_1$ | $L_2$ | $L_3$ |
|---|---|---|---|---|---|---|---|---|---|
| Element 1 | 70 | 70 | 59 | 59 | 68 | 68 | 28.5 | 7 | 15 |
| Element 2 | 55 | 55 | 46 | 46 | 56 | 56 | 22.5 | 8 | 15 |
| Parameter | $L_4$ | $L_5$ | $D_1$ | $D_2$ | $D_3$ | $D_4$ | $D_5$ | $W_1$ | $R_1$ |
| Element 1 | 4.5 | 24.5 | 10 | 12 | 3.4 | 24.5 | 18 | 2.5 | 1 |
| Element 2 | 5.5 | 20.5 | 11.5 | 14 | 3.4 | 17.5 | 12.5 | 2.5 | 1 |
| Parameter | $R_2$ | $H_1$ | $H_2$ | $H_3$ | | | | | |
| Element 1 | 2.4 | 2 | 9 | 3 | | | | | |
| Element 2 | 2.4 | 2 | 9 | 3 | | | | | |
| Parameter | $S_1$ | d | $S_3$ | $S_4$ | | | | | |
| Value | 200 | 45 | 6 | 6 | | | | | |

In above table I, Element 1 represents the first filtering antenna element with larger size for DCS band and Element 2 represents the second filtering antenna element with smaller size for WCDMA band. To ease the fabrication process, the two elements share the same sub-substrate with a relative permittivity of 2.65 and a thickness of 3 mm. For a better comparison, a traditional design using two nonfiltering antenna elements with the same edge-to-edge spacing is investigated, in which the shorting pins and E-slot are removed. The comparison results of the two antenna unit pairs are presented in FIG. 9A-9D. As observed in FIG. 9A-9B, good agreement between the simulation and measurement is achieved and the filtering antenna unit pair features high isolation of more than 30 dB. The measured impedance band-widths are 14.9% (1620-1880 MHz) for the DCS band and 17.9% (1920-2300 MHz) for the WCDMA band. With reference to the reflection coefficients ($S_{11}$ and $S_{22}$) and bore-sight gain responses, good in-band radiating performance and high out-of-band rejection levels are obtained. Meanwhile, in FIG. 9C-9D, it can be clearly seen that both the reflection coefficients and gains have gentle gradients at the edges of passband, and the isolation is only ~22 dB. The comparison verifies that the improved mutual coupling suppression in the proposed design is due to the use of filtering antenna elements.

Figure 10A:
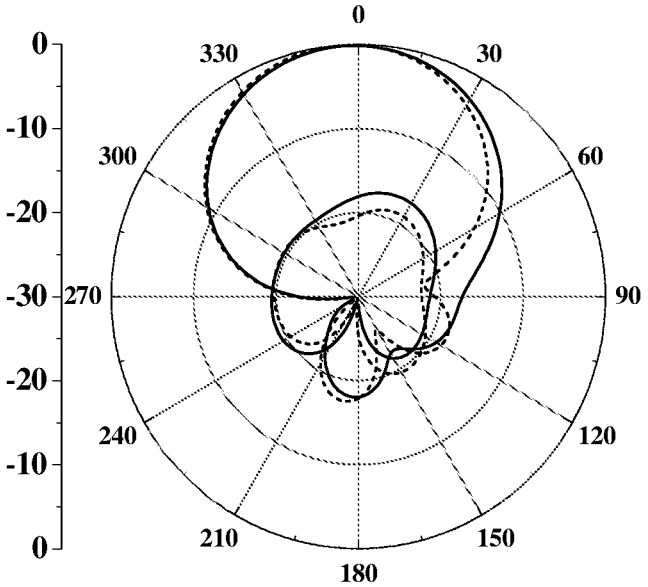
FIGS. 10A-10B are diagrams showing simulated and measured radiation patterns of the first filtering antenna element for DCS band at 1.8 GHz.
Figure 10B:
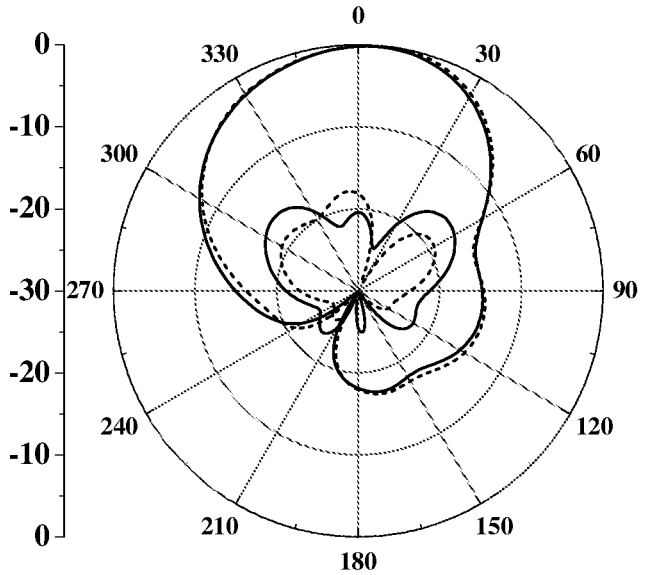
Figure 11A:
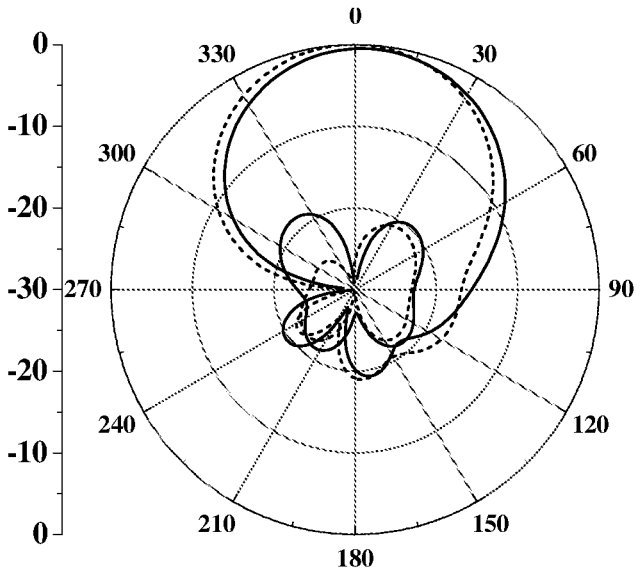
FIGS. 11A-11B are diagrams showing simulated and measured radiation patterns of the second filtering antenna element for WCDMA band at 2.06 GHz.
Figure 11B:
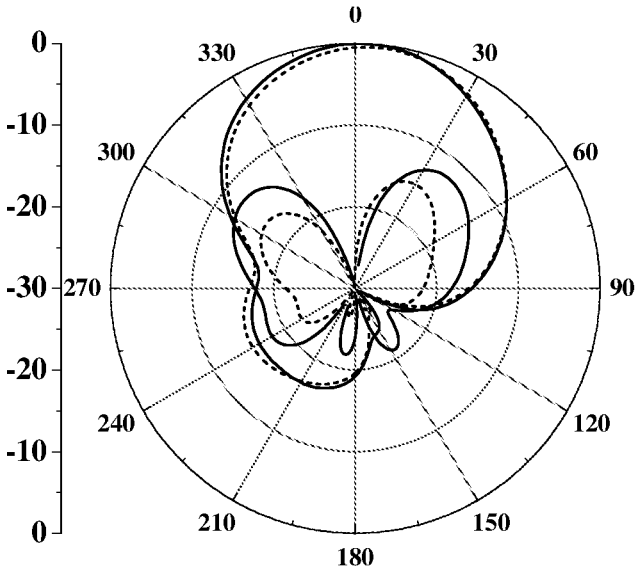

FIG. 10A-10B are diagrams showing simulated and measured radiation patterns of the first filtering antenna element for DCS band at 1.8 GHz. FIG. 11A-11B are diagrams showing simulated and measured radiation patterns of the second filtering antenna element for WCDMA band at 2.06 GHz. Referring FIG. 10A-11B, stable broadside radiation patterns are observed. The 3-dB beamwidths of E-plane and H-plane patterns are ~63° and ~68° at 1.8 GHz, and ~62° and ~62° at 2.06 GHz, respectively. The results show that the radiation performance of both antenna elements is almost not affected even when they are placed close to each other, which is due to the high isolation between the two elements.

Figure 12A:
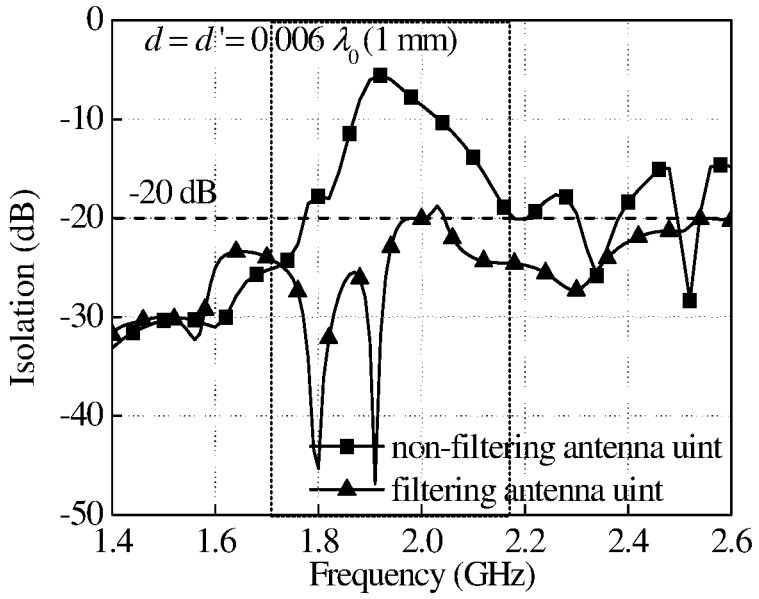
FIGS. 12A-12C are diagrams showing the simulated isolation levels when $d=d'=0.006\lambda_0$ (1 mm), $d=d'=0.25\lambda_0$ (42 mm) and $d=d'=0.5\lambda_0$ (84 mm), respectively.
Figure 12B:
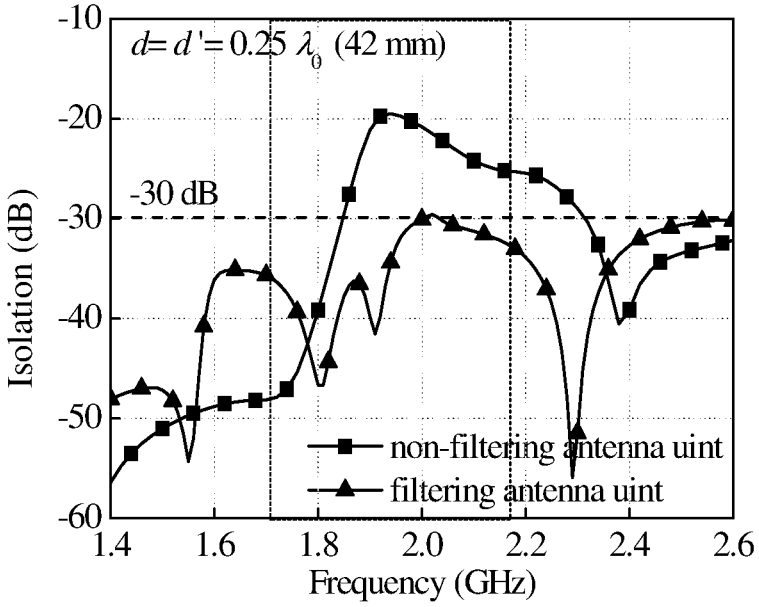
Figure 12C:
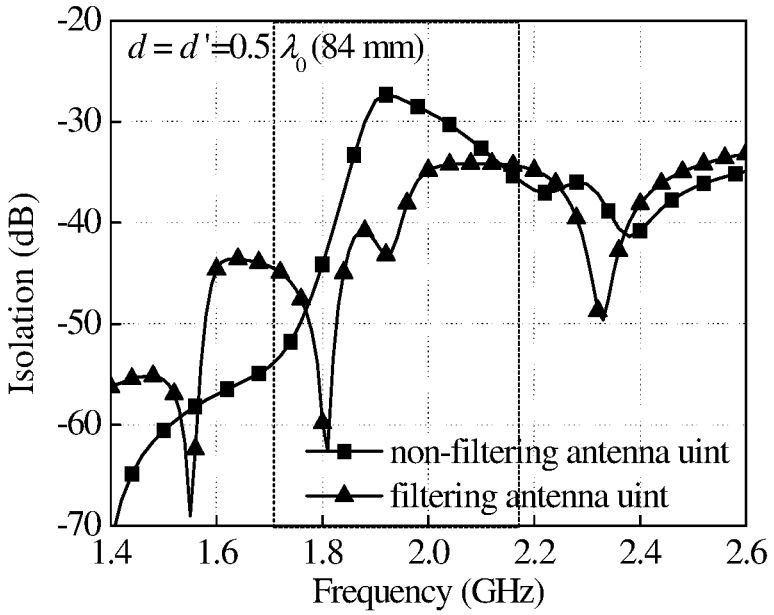

The isolation issue is further studied as follows. In the proposed design, it depends on not only the out-of-band suppression levels of the filtering antenna elements but also the frequency separation of the two operating bands. In general, higher out-of-band suppression and wider frequency spacing result in higher isolation. Besides, the edge-to-edge spacing between antenna elements has great impact on isolation. To explore the limitation of the mutual coupling reduction, three cases are studied with the edge-to-edge spacings being d=1 mm ($0.006\lambda_0$, $\lambda_0$ is the corresponding wavelength in free space), d=42 mm ($0.25\lambda_0$), and d=84 mm ($0.5\lambda_0$). FIG. 12A-12C illustrates the simulated isolation levels when $d=d'=0.006\lambda_0$ (1 mm), $d=d'=0.25\lambda_0$ (42 mm) and $d=d'=0.5\lambda_0$ (84 mm), respectively. As observed, the isolation is lower than approximately 20 dB when d=1 mm. That is to say, even if the two elements are very close to each other, high isolation can still be maintained, showing the advantage of adopting the filtering antenna elements. Further investigation shows that the mutual coupling decreases fleetly as the distance d increases and the isolation becomes higher than 30 dB when d=42 mm. When d increases from 42 mm to 84 mm, a 5-dB further improvement is obtained. The analysis reveals that an isolation ranging from 20 to 35 dB can be achieved using different edge-to-edge spacings. For comparison, the results of corresponding nonfiltering antenna unit pair are also plotted in FIG. 12A-12C. Around a 10-dB difference in isolation level is observed with/without the filtering antenna design, verifying the feasibility and effectiveness of the proposed approach, especially when the two antenna elements are very close to each other. It is noted that if further isolation enhancement and more compact size are simultaneously required, such as an isolation of more than 40 dB with only d=42 mm, both the filtering antenna elements and the decoupling feed networks can be adopted to meet the requirements.

Although in the present embodiment, just one filtering antenna element is shown in the first sub-array 2 and second sub-array 3, respectively, one skilled in the art should know that, more antenna elements are thinkable.

For base station applications, a dual-band filtering antenna array needs to meet some general specifications. For instance, the polarization direction of the sub-arrays should be the same. The horizontal beam widths should be within the range of 65°±5°. Suppressed side-lobe levels and null filling below the main beam of vertical radiation patterns are required. Besides, the port-to-port isolation between two sub-arrays must be more than 30 dB and the size should be as compact as possible. According to these requirements, a compact dual-band antenna array based on the predesigned filtering antenna elements is developed for DCS and WCDMA applications.

Figure 13:
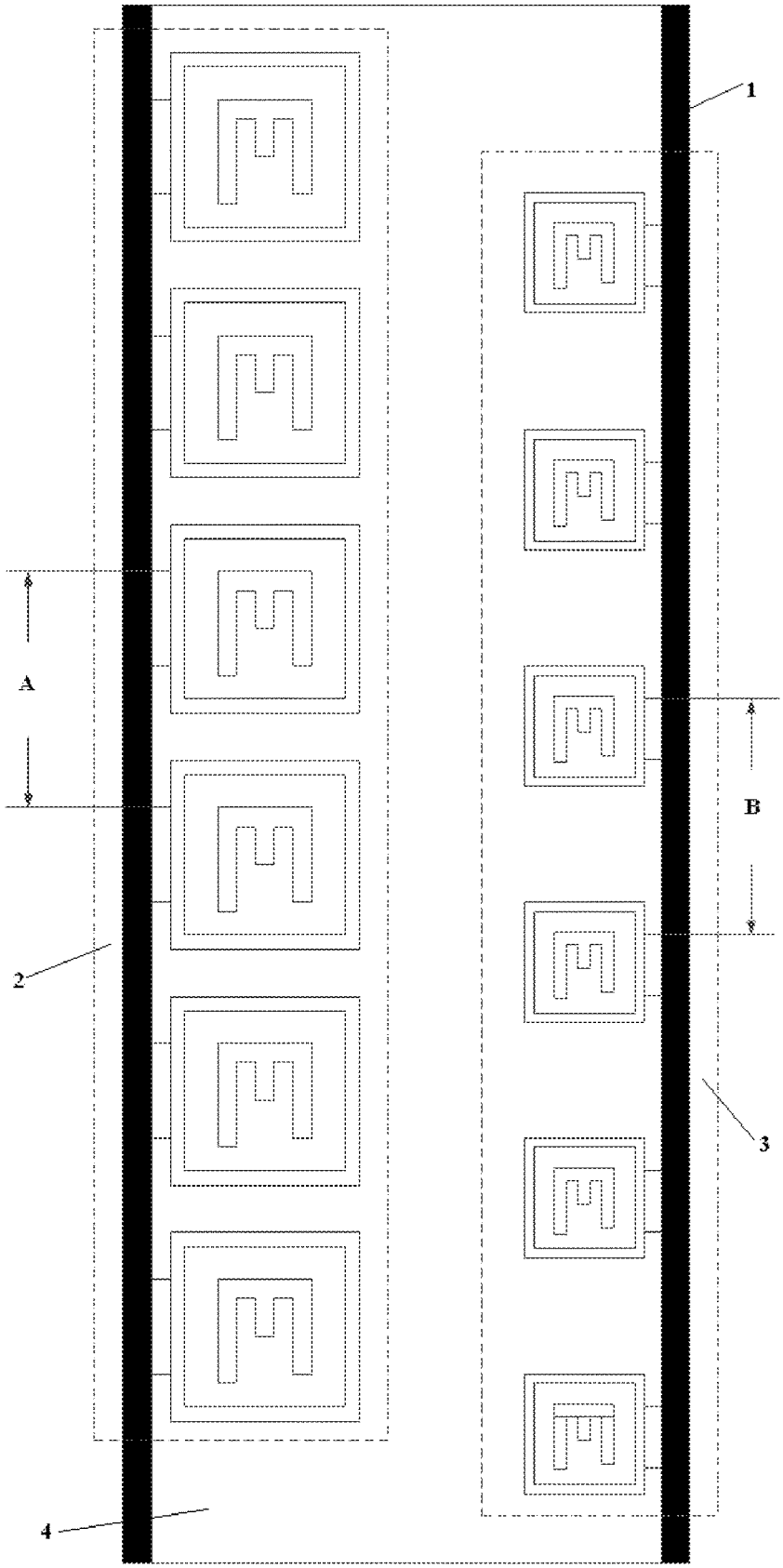
FIG. 13 is a diagram of the dual-band filtering antenna array according to another embodiment of the present application.

FIG. 13 has shown the configuration of the dual-band filtering antenna array. As shown in FIG. 13, the dual-band filtering antenna array comprises a first sub-array 2 and a second sub-array 3 arranged on a common ground plate 4. The first sub-array 2 consists of six first filtering antenna elements with larger size for DCS band, and the second sub-array 3 consists of six second filtering antenna elements with smaller size for WCDMA band. One skilled in the art should know that the first and second filtering antenna elements can be constructed according to the embodiments discussed above.

As shown in FIG. 13, the element spacing between the six first filtering antenna elements is 130 mm (~$0.78\lambda_0$ in the DCS band), and the element spacing between the six second filtering antenna elements is also 130 mm (~$0.87\lambda_0$ in the WCDMA band). The first sub-array 2 and the second sub-array 3 are placed side-by side along a vertical direction to ensure that they have the same polarization direction. The edge-to edge spacing between the first sub-array 2 and the second sub-array 3 is 45 mm. In addition, there is an offset of a fixed distance between the first sub-array 2 and the second sub-array 3 in the horizontal direction to further improve the port-to-port isolation. Two vertical aluminum reflection baffles Tare added on the edges of the ground plate 4 to control the 3-dB beamwidths of the H-plane radiation patterns. The height of the vertical aluminum reflection baffles 1 on the side of WCDMA band array is 20 mm, while the height of the vertical aluminum reflection baffles ion the other side is 8 mm. The size of the complete antenna array, including the ground plate 4 and the two refection baffles 1, is 835 mm (length)×206 mm (width)×20 mm (height). Compared with the 290-mm width of the industrial products, a size reduction of 28.9% is achieved.

As mentioned above, vertical radiation patterns with null filling below the main beam is demanded to reduce the variation of signal strength in the service area. Moreover, a typical base station antenna array requires that the first null depth below the main beam should be more than −20 dB and the side-lobe levels are less than −16 dB. To meet these requirements, beam pattern synthesis method is used to design the feed network for dual-band filtering antenna array consists of two 1×6 sub-arrays. The feed network consists of a planar six-way unequal power divider and six flexible coaxial cables. The latter is used to feed all the 1×6 sub-array elements. The lengths of the six coaxial cables can be tuned to adjust the phase for each element. For simplicity, the feed network is designed to cover 1710-2170 MHz, which is suitable for both of the sub-arrays.

Figure 14:
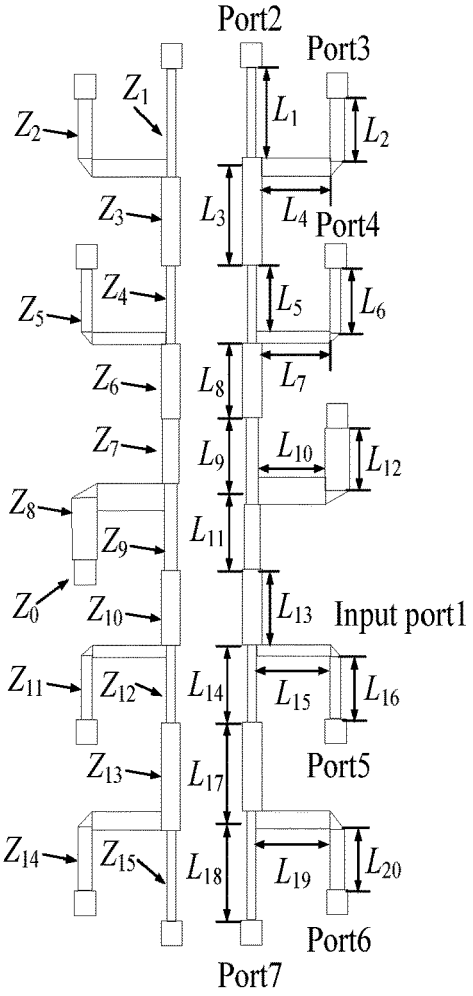
FIG. 14 is a diagram showing the power divider of the dual-band filtering antenna array in FIG. 13.

FIG. 14 is a diagram showing the power divider of the dual-band filtering antenna array in FIG. 13. Detailed parameters are listed in Tables II and III. The power divider is fabricated on a substrate with a relative permittivity of 2.65 and a thickness of 1.524 mm and the coaxial cables are Kingsignal 670-141LSZH.

TABLE II

PARAMETERS OF THE FEED NETWORK

| Length | $L_1$ | $L_2$ | $L_3$ | $L_4$ | $L_5$ | $L_6$ | $L_7$ | $L_8$ |
|---|---|---|---|---|---|---|---|---|
| Value (mm) | 24.9 | 13.2 | 19 | 12.6 | 25.3 | 13.4 | 12.7 | 23 |
| Length | $L_9$ | $L_{10}$ | $L_{11}$ | $L_{12}$ | $L_{13}$ | $L_{14}$ | $L_{15}$ | $L_{16}$ |
| Value (mm) | 23.5 | 10.7 | 23.6 | 14.3 | 21.8 | 25.3 | 11.7 | 13.3 |
| Length | $L_{17}$ | $L_{18}$ | $L_{19}$ | $L_{20}$ | | | | |
| Value (mm) | 17.7 | 24.9 | 11.6 | 13.3 | | | | |
| Impedance | $Z_0$ | $Z_1$ | $Z_2$ | $Z_3$ | $Z_4$ | $Z_5$ | $Z_6$ | $Z_7$ |
| Value (Ω) | 50 | 79.7 | 62.8 | 50 | 68 | 75 | 50 | 56.6 |
| Impedance | $Z_8$ | $Z_9$ | $Z_{10}$ | $Z_{11}$ | $Z_{12}$ | $Z_{13}$ | $Z_{14}$ | $Z_{15}$ |
| Value (Ω) | 43 | 66.3 | 50 | 70 | 71 | 50 | 65.7 | 74.5 |

Figure 15:
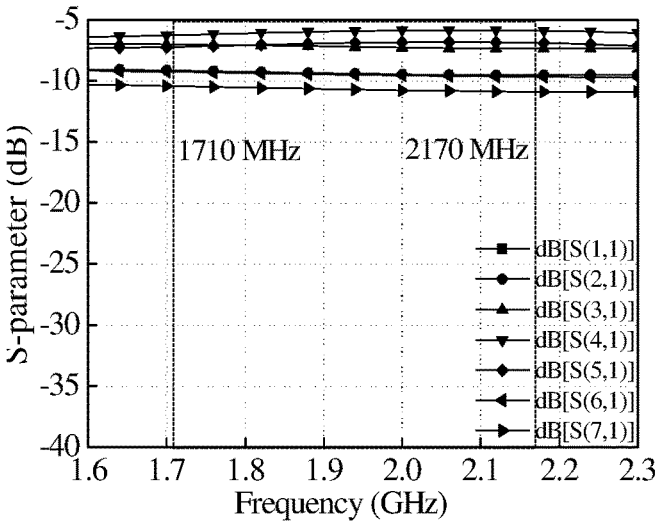
FIG. 15 is a diagram showing the simulated S-parameters of this power divider in FIG. 14.

FIG. 15 shows the simulated S-parameters of this power divider. It can be observed that good impedance matching of $|S_{11}|<-19$ dB is obtained over the 1710-2170-MHzband. Simultaneously, the magnitude and phase of input power for each element are achieved to form the desired beam patterns.

Figure 16A:
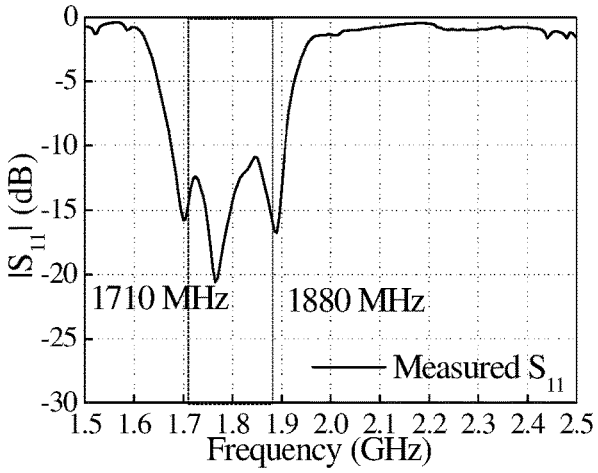
FIGS. 16A-16C are diagrams showing measured results of the reflection coefficient of the first sub-array, the second sub-array and the isolation parameter $|S_{11}|$ of the dual-band filtering antenna array in FIG. 13.
Figure 16B:
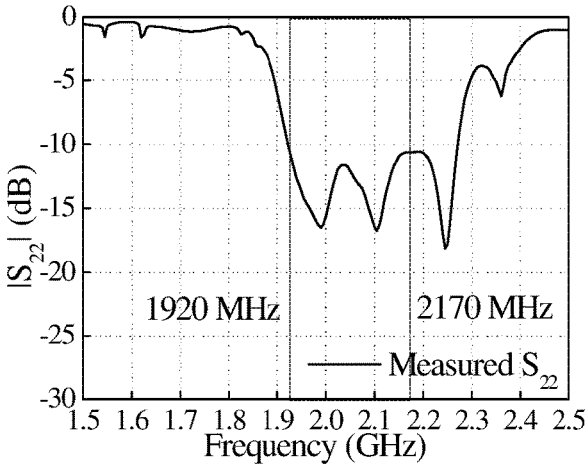
Figure 16C:
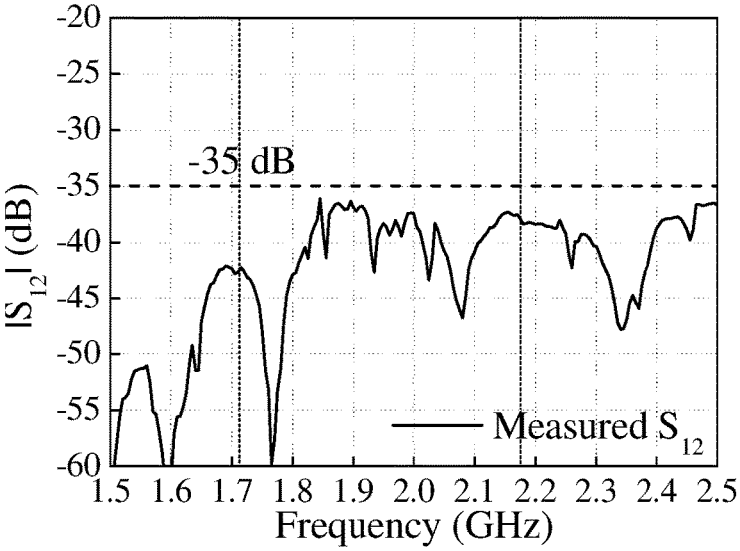
Figure 17:
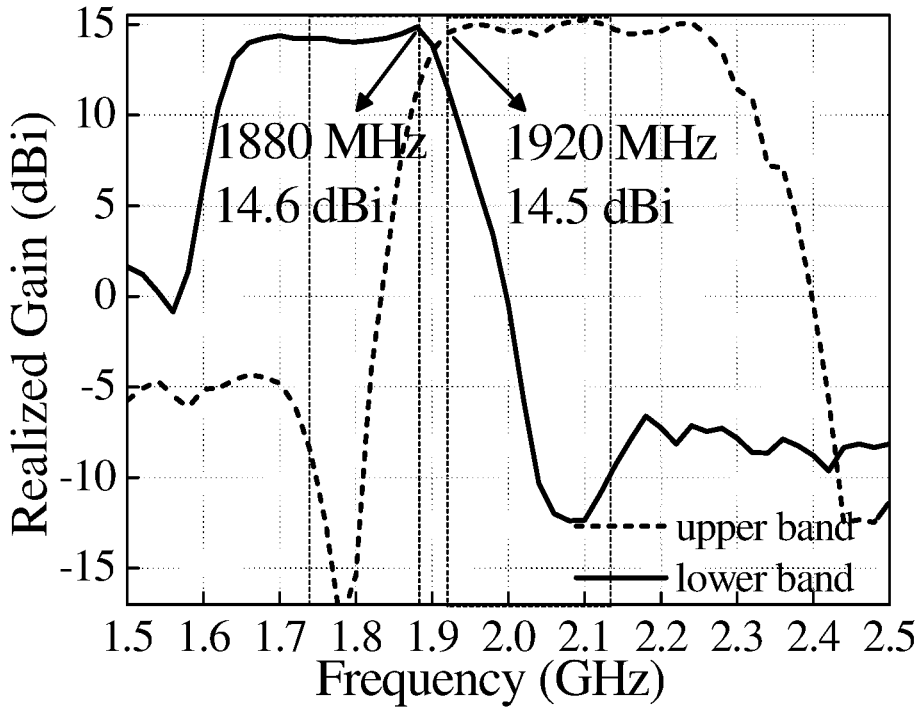
FIG. 17 is a diagram showing the measured boresight gains of the dual-band filtering antenna array in FIG. 13.
Figure 18A:
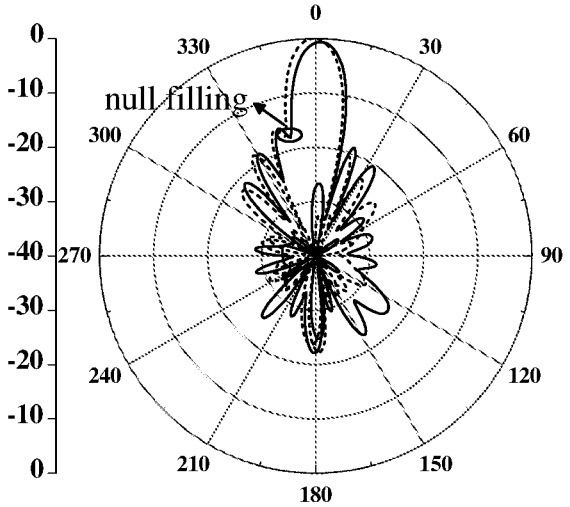
FIGS. 18A-18D are diagrams showing the measured and simulated radiation patterns at the middle frequencies of the DCS band (1.8 GHz) and the WCDMA band (2.06 GHz).
Figure 18B:
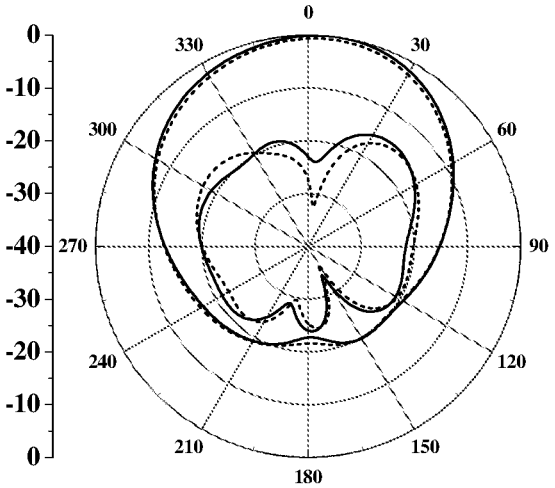
Figure 18C:
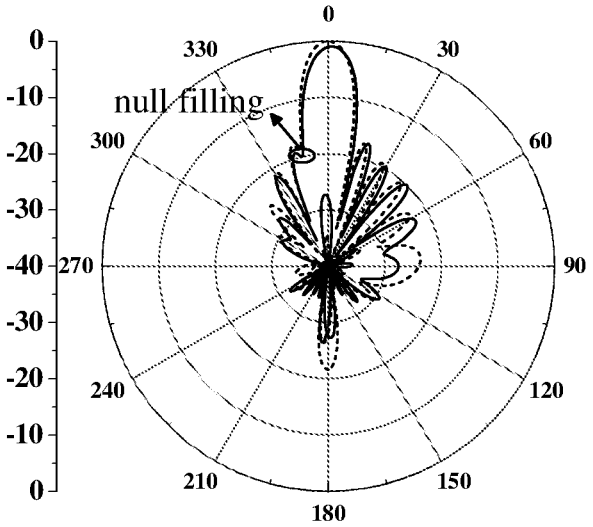
Figure 18D:
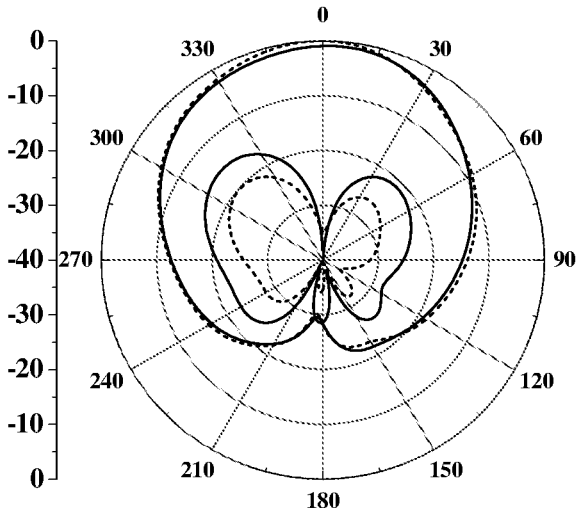

FIG. 16A-16C are diagrams showing measured results of the reflection coefficient of the first sub-array, the second sub-array and the isolation parameter $|S_{11}|$ of the dual-band filtering antenna array in FIG. 13. It can be seen that the measured reflection coefficient is lower than −10 dB within the entire DCS band of 1710-1880 MHz and the WCDMA band of 1920-2170 MHz. The measured isolation is more than 35 dB from 1500 to 2500 MHz, showing high isolation between the two ports of the sub-arrays FIG. 17 is a diagram showing the measured boresight gains of the dual-band filtering antenna array in FIG. 13. The measured gains are about 14.2 dBi within the DCS band and 14.5 dBi within the WCDMA which are comparable to the gains of six-element arrays for base station applications. The gain variation of each array is less than 0.5 dB in the whole operating band. It is also noted that there are two radiation nulls located at 1.56 and 2.08 GHz in the lower band and at 1.78 and 2.44 GHz in the upper band, resulting in high frequency selectivity.

FIG. 18A-18D are diagrams showing the measured and simulated radiation patterns at the middle frequencies of the DCS band (1.8 GHz) and the WCDMA band (2.06 GHz), with good agreement observed. It is worth mentioning that the sidelobe levels are below −16 dB in the E-plane patterns. The phenomenon of the first null filling can be found below the main beam and the first null depth is −17 dB. The 3-dB beamwidths in the E-plane are ~13° at 1800 MHz and ~9° at 2060 MHz, whereas those in the H-plane are ˆ70° at 1800 MHz and ˆ66° at 2060 MHz. With these features, the proposed array is suitable for potential base station applications.

To sum up, the present application has disclosed a filtering antenna element, and a dual-band filtering antenna array using filtering antenna elements for mutual coupling suppression. In the present application, a compact dual-band antenna array operating at DCS band (1710-1880 MHz) and WCDMA band (1920-2170 MHz) has further been proposed. More than a 35-dB port-to-port isolation has been obtained by utilizing filtering antenna elements as array elements. Less than −16 dB sidelobe level and first null depth of −17 dB below the main beam have been obtained by elaborately designing the feed network. The width of the present dual-band filtering antenna array is only 206 mm, 28.9% smaller than that (290 mm) of the industry products using nonfiltering antenna elements. These characteristics make the proposed design a good candidate for base station system applications. Moreover, the proposed method for mutual coupling suppression can also be applied to the designs of dual-polarized multiband arrays.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A filtering antenna element comprising a feeding element, a sub-substrate, a sup-substrate and an air gap between the sub-substrate and the sup-substrate, wherein, a stacked patch is fabricated on a top surface of the sub-substrate, a driven patch and a ground plane are fabricated on a top surface and a bottom surface of the sub-substrate, respectively, wherein, an asymmetric E-slot is arranged on the driven patch and an shorting pin is inserted into the sub-substrate for generating radiation nulls in stopbands.

2. The filtering antenna element according to claim 1, wherein three shorting pins are provided, one shorting pin is located opposite to the feeding element, and other two shorting pins are positioned symmetrically with respect to a vertical axis of the sub-substrate.

3. The filtering antenna element according to claim 1, wherein the asymmetric E-slot has three slot arms with different lengths.

4. The filtering antenna element according to claim 3, wherein a middle slot arm of the asymmetric E-slot is shorter that two side slot arms of the asymmetric E-slot.

5. The filtering antenna element according to claim 1, wherein the filtering antenna element further comprises a supporting pillar for connecting the sub-substrate and the sup-substrate.

6. A filtering antenna element comprising a feeding element, a sub-substrate, a sup-substrate and an air gap between the sub-substrate and the sup-substrate, wherein, a stacked patch is fabricated on a top surface of the sub-substrate, a driven patch and a ground plane are fabricated on a top surface and a bottom surface of the sub-substrate, respectively, wherein, a slot is arranged on the driven patch and three shorting pins are inserted into the sub-substrate for generating radiation nulls in stopbands, wherein one shorting pin is located opposite to the feeding element, and other two shorting pins are positioned symmetrically with respect to a vertical axis of the sub-substrate; wherein the slot is an asymmetric E-slot having three slot arms with different lengths, wherein a middle slot arm of the asymmetric E-slot is shorter that two side slot arms of the asymmetric E-slot.

7. A dual-band filtering antenna array comprising a first sub-array and a second sub-array arranged on a common ground plate, wherein, the first sub-array is operating at a first frequency band, and the second sub-array is operating at a second frequency band which is different from the first frequency band, wherein the first sub-array comprises at least one first filtering antenna element and the second sub-array comprises at least one second filtering antenna element, wherein the first filtering antenna element and the second filtering antenna element comprises a feeding element, a sub-substrate, a sup-substrate and an air gap between the sub-substrate and the sup-substrate, respectively, wherein, a stacked patch is fabricated on a top surface of the sub-substrate, a driven patch and a ground plane are fabricated on a top surface and a bottom surface of the sub-substrate, respectively, wherein, an asymmetric E-slot is arranged on the driven patch and an shorting pin is inserted into the sub-substrate for generating radiation nulls in stop-bands.

8. The dual-band filtering antenna array according to claim 7, wherein the first filtering antenna element and the second filtering antenna element are different in size, wherein the first filtering antenna element has a large size, and the second filtering antenna element has a smaller size.

9. The dual-band filtering antenna array according to claim 8, the first frequency band is DCS frequency band, and the second frequency band is WCDMA frequency band.

10. The dual-band filtering antenna array according to claim 9, wherein the first sub-array comprises six filtering antenna elements and the second sub-array comprises six second filtering antenna elements.

11. The dual-band filtering antenna array according to claim 9, wherein a distance between neighbor first filtering antenna elements is equal to a distance between neighbor second filtering antenna elements.

12. The dual-band filtering antenna array according to claim 7, wherein the first sub-array comprises a plurality of first filtering antenna elements and the second sub-array comprises a plurality of second filtering antenna elements, wherein the first sub-array and the second sub-array are placed side-by side along a vertical direction.

13. The dual-band filtering antenna array according to claim 7, wherein an offset of a fixed distance is arranged between the first sub-array and the second sub-array in a horizontal direction.

14. The dual-band filtering antenna array according to claim 7, wherein at least two reflection baffles are added on edges of the common ground plate.

15. The dual-band filtering antenna array according to claim 14, wherein the reflection baffles are vertical aluminum reflection baffles with different heights.

16. The dual-band filtering antenna array according to claim 7, wherein three shorting pins are provided, one shorting pin is located opposite to the feeding element, and other two shorting pins are positioned symmetrically with respect to a vertical axis of the sub-substrate.

17. The dual-band filtering antenna array according to claim 16, wherein the asymmetric E-slot has three slot arms with different lengths.

18. The dual-band filtering antenna array according to claim 17, wherein a middle slot arm of the asymmetric E-slot is shorter that two side slot arms of the asymmetric E-slot.

19. The dual-band filtering antenna array according to claim 7, wherein the filtering antenna element further comprises a supporting pillar for connecting the sub-substrate and the sup-sub state.

* * * * *